US012109617B2

(12) United States Patent
Kwon

(10) Patent No.: US 12,109,617 B2
(45) Date of Patent: Oct. 8, 2024

(54) METHOD FOR MANUFACTURING COMPOSITE MATERIAL FOR THERMAL SHIELDS, AND COMPOSITE MATERIAL FOR THERMAL SHIELDS MANUFACTURED THEREBY

(71) Applicant: PUKYONG NATIONAL UNIVERSITY INDUSTRY-UNIVERSITY COOPERATION FOUNDATION, Busan (KR)

(72) Inventor: Hansang Kwon, Busan (KR)

(73) Assignee: Pukyong National University Industry-University Cooperation Foundation, Busan (KR)

( * ) Notice: Subject to any disclaimer, the term of this patent is extended or adjusted under 35 U.S.C. 154(b) by 10 days.

(21) Appl. No.: 17/815,104

(22) Filed: Jul. 26, 2022

(65) Prior Publication Data

US 2022/0362845 A1 Nov. 17, 2022

Related U.S. Application Data

(63) Continuation of application No. PCT/KR2020/006645, filed on May 21, 2020.

(30) Foreign Application Priority Data

Jan. 31, 2020 (KR) ..... 10-2020-0011821

(51) Int. Cl.
*B22F 3/105* (2006.01)

(52) U.S. Cl.
CPC ..... *B22F 3/105* (2013.01); *B22F 2202/13* (2013.01); *B22F 2301/052* (2013.01);
(Continued)

(58) Field of Classification Search
CPC .... B22F 1/14; B22F 3/10; B22F 3/105; B22F 7/008; B22F 7/02; B22F 2003/1051;
(Continued)

(56) References Cited

U.S. PATENT DOCUMENTS

2009/0285712 A1* 11/2009 Gries ..... C22C 29/005 419/30
2021/0205883 A1* 7/2021 Yousefiani ..... C22C 1/05

FOREIGN PATENT DOCUMENTS

JP 08337802 A * 12/1996
JP H08-337802 A 12/1996
(Continued)

OTHER PUBLICATIONS

International Search Report mailed Dec. 8, 2020 in International Application No. PCT/KR2020/006645.

*Primary Examiner* — Kevin Ct Li
(74) *Attorney, Agent, or Firm* — Knobbe, Martens, Olson & Bear, LLP

(57) ABSTRACT

A method of manufacturing a composite material for thermal shields, and a composite material manufactured by the method are proposed. The method may include preparing a mixed powder including (i) a metal powder including a powder of aluminum or aluminum alloy and (ii) a polymer or ceramic powder. The method may also include sintering the mixed powder through pressureless sintering or spark plasma sintering to produce a composite material. According to the present disclosure, a powder of polymer, ceramic, and/or metal which have a relatively low level of thermal conductivity can be compounded with a metal material including aluminum through a sintering process of powder metallurgy, such as pressureless sintering or spark plasma sintering. Thus, a heterogeneous composite material with a low-level thermal conductivity (10 W/mk or less) can be
(Continued)

obtained, and the composite material can be used as a material for various thermal shields.

3 Claims, 4 Drawing Sheets

(52) U.S. Cl.
CPC ... *B22F 2302/253* (2013.01); *B22F 2302/256* (2013.01); *B22F 2302/45* (2013.01)

(58) Field of Classification Search
CPC ..... B22F 2301/052; B22F 2302/253; B22F 2302/256; B22F 2302/45; B22F 2999/00; B22F 2202/13; F01D 5/282; F01D 5/288; F01D 2230/314; F01D 2230/90; F01D 2300/2261; F01D 2300/6033; C08L 67/00; C22C 1/05; C22C 1/0416; C22C 1/051
See application file for complete search history.

(56) References Cited

FOREIGN PATENT DOCUMENTS

| | | | | |
|---|---|---|---|---|
| KR | 10-2007-0010118 | A | | 1/2007 |
| KR | 10-0778071 | B1 | | 11/2007 |
| KR | 10-2015-0143278 | A | | 12/2015 |
| KR | 10-2016-0013377 | A | | 2/2016 |
| KR | 20160013377 | A | * | 10/2016 |
| KR | 10-2018-0001609 | A | | 1/2018 |
| KR | 10-2018-0050014 | A | | 5/2018 |

* cited by examiner

| Composition | conditions for pressureless sintering | Top view | Side view | Electrical conductivity (Ω) |
|---|---|---|---|---|
| AlSium-10vol.%PAR | 350℃, 1hr |  |  | Top, Bottom: insulated Side: conducted |
| AlSium-15vol.%PAR | |  |  | insulated |
| AlSium-16vol.%PAR | |  |  | insulated |
| AlSium-18vol.%PAR | |  |  | insulated |
| AlSium-20vol.%PAR | |  |  | insulated |
| AlSium-30vol.%PAR | |  |  | insulated |

| Composition | Milling condition | conditions for spark plasma sintering(SPS) | Electrical resistance (Ω) |
|---|---|---|---|
| AlSium-10vol.%PAR | 160rpm, 24h, 20ml | 300℃, 40MPa, 3min | conducted |
| AlSium-18vol.%PAR | | | insulated |
| AlSium-20vol.%PAR | | | insulated |
| AlSium-30vol.%PAR | | | insulated |

FIG. 3

| Composition | Milling condition | conditions for spark plasma sintering(SPS) | Top view | Electrical resistance (Ω) |
|---|---|---|---|---|
| AlSium-30vol.%PAR | 160rpm, 24h, 20ml | 300℃, 40MPa, 3min |  | insulated |
| Al-30vol.%PAR | | |  | insulated |
| Mg-30vol.%PAR | | |  | insulated |
| Al5052-30vol.%PAR | | |  | conducted |

METHOD FOR MANUFACTURING COMPOSITE MATERIAL FOR THERMAL SHIELDS, AND COMPOSITE MATERIAL FOR THERMAL SHIELDS MANUFACTURED THEREBY

CROSS-REFERENCE TO RELATED APPLICATIONS

This application is a continuation application, and claims the benefit under 35 U.S.C. § 120 and § 365 of PCT Application No. PCT/KR2020/006645, filed on May 21, 2020, which claims priority to Korean Patent Application No. 10-2020-0011821 filed on Jan. 31, 2020, both of which are hereby incorporated by reference in their entirety.

BACKGROUND

The present disclosure relates to a method for manufacturing a metal matrix composite material for thermal shields having excellent thermal insulation properties and to a composite material for thermal shields manufactured by the method.

SUMMARY

One aspect is a method for manufacturing a composite material for thermal shields having excellent thermal insulation properties by compounding different materials on an aluminum-containing metal matrix and to provide a composite material for thermal shields, manufactured by the method.

Another aspect is a method for manufacturing a composite material for thermal shields, the method including: (a) preparing a mixed powder including (i) a metal powder including a powder made of aluminum or an aluminum alloy and (ii) a polymer or ceramic powder, and (b) preparing a composite material by sintering the mixed powder through pressureless sintering or spark plasma sintering.

In addition, in the method, the mixed powder may include (i) 30% to 85% by volume of a metal powder including a powder made of aluminum or an aluminum alloy, and (ii) 15% to 70% by volume of a polymer or ceramic powder.

In addition, in the method, the metal powder may further include a stainless steel powder.

In addition, in the method, the ceramic powder may be made of at least one selected from the group consisting of MgO, $SiO_2$, and $Al_2O_3$.

In addition, in the method, the polymer powder may be made of polyarylate (PAR).

Furthermore, the present disclosure proposes a composite material for thermal shields, the composite material manufactured by the method.

In addition, the composite material may include 70% to 85% by volume of aluminum or aluminum alloy and 15% to 30% by volume of polyarylate (PAR).

In addition, the composite material may be a functionally graded material (FGM) having a sheet shape and being formed such that the polymer or ceramic continuously changes in volume fraction from one side to the other in at least one direction of a thickness direction, a length direction, and a width direction of the sheet.

According to the present disclosure, in the method of manufacturing a composite material for thermal shields, a polymer powder, a ceramic powder, and/or a metal powder having relatively low thermal conductivity is compounded with a metal material including aluminum through a sintering process using a powder metallurgy method such as pressureless sintering or spark plasma sintering. Thus, a heterogeneous composite material with a low-level thermal conductivity of 10 W/mk or less can be obtained. The composite material can be used as a material for various thermal shields.

BRIEF DESCRIPTION OF THE DRAWINGS

FIG. 3 is a photograph and illustrates electrical conductivity measurement results of a sample of an Al—Mg alloy (AlSium)/polyarylate (PAR) composite material prepared through spark plasma sintering according to one embodiment of the present application.

DETAILED DESCRIPTION

Figure 1:
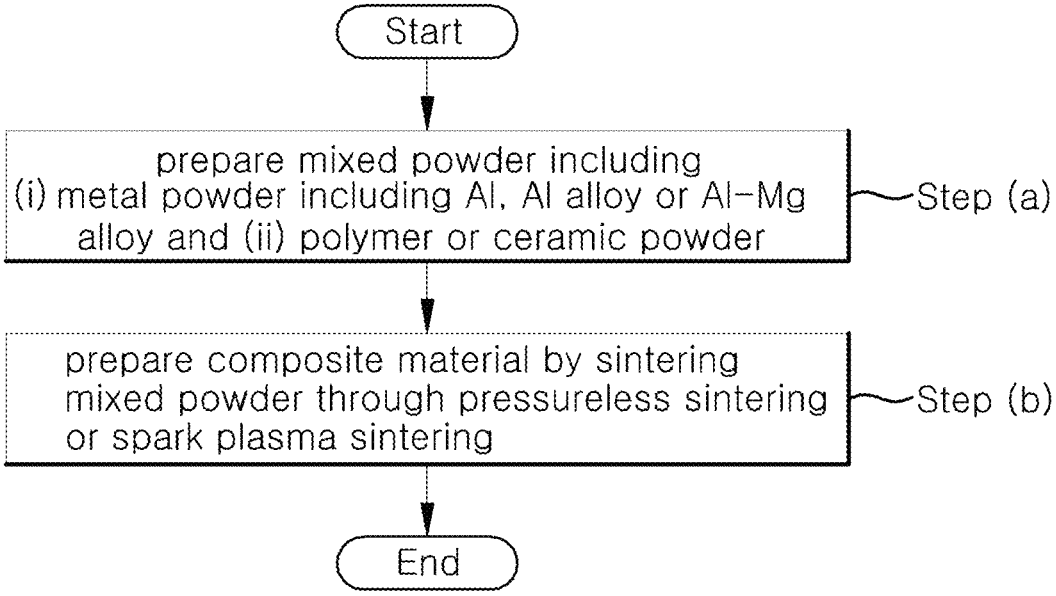
FIG. 1 is a process flowchart illustrating a method of manufacturing a composite material for thermal shields, according to the present disclosure.

Various parts and electronic devices used in the automobile and electronic industries are continuously undergoing greater-scale integration, miniaturization, and weight reduction. As the degree of integration of various parts and electronic devices increases, heat generated inside devices also increases.

As described above, the heat generated inside devices may cause various problems such as deterioration of functions of parts or elements, malfunctions of parts or elements, or deterioration of materials.

For example, the existing automotive headlight lens support material is typically an aluminum casting product and thus has high thermal conductivity (~150 W/mk), which may cause deterioration of surrounding plastic connecting parts when used for a long time, leading to shortened product lifespan and failure.

For this reason, there is a need for development of a metal-based material having adequate thermal insulation properties.

In describing the present disclosure, well-known functions or constructions will not be described in detail when it is determined that they may obscure the gist of the present disclosure.

Since embodiments in accordance with the concept of the present disclosure can undergo various changes and have various forms, only some specific embodiments are illustrated in the drawings and described in detail in the present specification. While specific embodiments of the present disclosure are described herein below, they are only for illustrative purposes and should not be construed as limiting to the present disclosure. Thus, the present disclosure should be construed to cover not only the specific embodiments but also cover all modifications, equivalents, and substitutions that fall within the concept and technical spirit of the present disclosure.

The terminology used herein is for the purpose of describing particular embodiments only and is not intended to limit the scope of the present disclosure. As used herein, the singular forms "a", "an", and "the" are intended to include the plural forms as well unless the context clearly indicates otherwise. It will be further understood that the terms "comprise" or "has" when used in the present specification specify the presence of stated features, regions, integers, steps, operations, elements and/or components, but do not preclude the presence or addition of one or more other features, regions, integers, steps, operations, elements, components and/or combinations thereof.

Hereinafter, embodiments of the present disclosure will be described in detail.

The present disclosure provides a method for manufacturing a composite material for thermal shields, the method including: (a) preparing a mixed powder including (i) a metal powder including a powder made of aluminum or an aluminum alloy and (ii) a polymer or ceramic powder, and (b) preparing a composite material by sintering the mixed powder through pressureless sintering or spark plasma (see FIG. 1)

In step (a), through various types of ball milling processes such as electric ball milling, stirring ball milling, planetary ball milling, and the like, a homogeneous mixed powder is prepared by mixing a metal powder containing aluminum or an aluminum alloy, etc., and a ceramic or polymer powder to reduce the thermal conductivity of the composite material. For example, a low energy milling process using a conventional electric ball milling apparatus may be performed at 100 to 500 rpm for 1 to 24 hours to prepare the mixed powder.

In this case, the aluminum alloy contained in the metal powder is one selected from the group consisting of 1000 series, 2000 series, 3000 series, 4000 series, 5000 series, 6000 series, 7000 series, and 8000 series. For example, the aluminum alloy may be Al—Cu alloy, Al—Mg alloy, Al—Mg—Si alloy, Al—Zn—Mg alloy, or Al—Mn alloy.

In addition, the metal powder may further include a powder of a metal such as aluminum and its alloy and stainless steel having a lower thermal conductivity than magnesium and magnesium alloy.

The ceramic powder added to reduce the thermal conductivity of the composite material manufactured by the method of the present disclosure preferably includes at lest one oxide-based ceramic selected from the group consisting of MgO, $SiO_2$, $Al_2O_3$, $TiO_2$, $Y_2O_3$, $ZrO_2$, $Ta_2O_5$, $ThO_2$, $ZrSiO_2$ BeO, $CeO_2$, $Cr_2O_3$, $HfO_2$, $La_2O_3$, and $Nb_2O_3$.

In addition, the polymer powder added to reduce the thermal conductivity of the composite material obtained by the manufacturing method according to the present disclosure is composed of a thermoplastic resin or a thermosetting resin.

Examples of the thermoplastic resin include: olefin resins such as polyethylene, polypropylene, and poly-4-methylpentene-1; acrylic resins such as polymethyl methacrylate and acrylonitrile; vinyl resins such as polyvinyl chloride, polyvinyl acetate, polyvinyl alcohol, polyvinyl butyral, polyvinyldenum chloride; styrene-based resins such as polystyrene and ABS resin; fluorine resins such as tetrafluoride ethylene resin, trifluoride ethylene resin, polyvinyl fluoride, and polyvinyl fluoride; and cellulose resins such as nitrocellulose, cellulose acetate, ethyl cellulose, and propylene cellulose. Aside from these examples, polyamide, polyamideimide, polyacetal, polycarbonate, polyethylene butyrate, polybutylene butarate, ionomo resin, polysulfone, polyethersulfone, polyphenylene ether, polyphenylene sulfide, polyetherimide, poly ether etherketone, aromatic polyester (Ekonol, polyarylate), etc. can also be used.

In addition, examples of the thermosetting resin include a phenol resin, an epoxy resin, and a polyimide resin.

The composition of the mixed powder prepared in step (a) is not particularly limited, and the mixing ratio of metal and ceramic or the mixing ratio of metal and polymer may vary depending on the parts, products, devices, etc. to which the finally manufactured thermal-shielding composite material will be applied. Preferably, the mixed powder may a uniformly mixed powder including (i) 30% to 85% by volume of a metal powder including a powder of aluminum or aluminum alloy and (ii) 15% to 70% by volume of a powder of polymer or ceramic.

On the other hand, step (a) may further include a step of preparing a molded article from the mixed powder prior to the pressureless sintering or spark plasma sintering (SPS) to be described later.

As a method of preparing the molded article, any conventional molding method using powder to produce a molded article can be used without limitations. For example, a method including the steps of supplying a mixed powder to a mold and producing a molded article through uniaxial pressure molding may be used.

In particular, when the composite material for thermal shields is manufactured from the mixed powder through spark plasma sintering in step (b) to be described later, a preliminary molded article may be manufactured by charging the mixed powder into the mold provided in the chamber of a spark plasma sintering apparatus. The mold may take any shape. For example, it may be rod-shaped or plate-shaped. Preferably, the mold may be made of a material that is stable even at high temperatures, such as cemented carbide (WC—Co), so as not to act as an impurity source during the spark plasma sintering process.

Next, in step (b), a composite material for thermal shields may be made from the mixed powder prepared in step (a) through pressureless sintering or spark plasma sintering.

In addition, in this step, (i) 30% to 85% by volume of a metal powder including a powder made of aluminum or an aluminum alloy, and (ii) a polymer or ceramic powder may be sintered through pressureless sintering or spark plasma sintering to produce a densified composite material for thermal shields.

In performing the pressureless sintering in this step, sintering conditions such as sintering temperature and sintering time may be appropriately determined depending on the types and contents of metal powder and polymer or ceramic powder included in the mixed powder, and the particle size and microstructure control of the composite material to be manufactured.

For example, when manufacturing a composite material through pressureless sintering from a mixed powder including a metal powder composed of aluminum or aluminum alloy and a polymer powder, this step is performed at a temperature in the range of 300° C. or higher but lower than 400° C. at atmospheric pressure for 1 to 6 hours.

When the sintering temperature is lower than 300° C., sintering cannot be sufficiently performed. When the sintering temperature is 400° C. or higher, it is difficult to control the shape of the composite material because the polymer melts. In addition, when the sintering time is shorter than 1 hour, it is difficult to achieve sufficient sintering. When the sintering time exceeds 6 hours, it is not preferable in terms of economical efficiency of the manufacturing process.

Regarding the sintering temperature described above, after determining arbitrary temperatures T1 and T2 (provided that $T1<T2$) belonging to the selected sintering temperature range determined depending on the type and content of raw powder, etc., the temperature is gradually raised from T1 to T2 for the sintering time. Alternatively, the sintering may be performed without changing the sintering temperature for a predetermined duration. When the sintering is performed without changing the temperature for a certain duration, the sintering temperature may be constantly maintained only at one temperature level for the whole sintering time. Alternatively, the temperature may be changed after being maintained for a predetermined duration. Each duration for which the temperature is maintained at a predetermined temperature level may be the same or may differ.

When using the spark plasma sintering in this step a DC current is applied to the mixed powder under pressure so that a spark discharge phenomenon occurs due to a pulsed DC current flowing between the particles of the mixed powder, whereby the mixed powder is sintered due to heat diffusion and electric field diffusion caused by the high energy of the momentarily generated spark plasma, the generation of heat caused by electric resistance of the mold, and the pressure and electric energy that are applied. The sintering causes the metal and the ceramic or polymer to be compounded, thereby producing a composite material having dense structure. Through this sintering, the growth of the particles of the composite material can be effectively controlled, and a thermal-shielding composition material with uniform microstructure can be manufactured.

In the present disclosure, the spark plasma sintering process may be performed using a spark plasma sintering apparatus including: a chamber accommodating a mold in which a mixed powder is to be sintered when spark plasma is generated between an upper electrode and a lower electrode to which an electric current is applied; a cooling unit configured to cool the chamber by circulating cooling water; a current supply unit configured to apply the electric current across the upper electrode and the lower electrode; a temperature detector configured to detect a temperature of the chamber; a pump configured to discharge air from an inner space of the chamber to the outside of the apparatus; a pressure adjusting unit configured to adjust an internal pressure of the chamber; a controller configured to adaptively control a spark plasma sintering process temperature according to the temperature detected by the temperature detector; and a manipulation unit used to operate the controller.

In this step, in order to sinter the mixed powder through the discharge plasma sintering, the inside of the chamber may be purged by the pump of the spark plasma sintering apparatus so that the internal pressure of the chamber is reduced to a vacuum pressure, whereby gas-phase impurities in the chamber are removed, and oxidation is prevented in the chamber.

In addition, after preheating the mixed powder by heating the mixed powder to the target sintering temperature at a predetermined temperature increase rate, the spark plasma sintering may be performed. Through the preheating of the mixed powder at the described temperature increase rate, the inner and outer portions of the mixed powder are uniformly heated, resulting in an thermal-shielding composite material with uniform structure.

In addition, the spark plasma sintering process can suppress the growth of particles constituting the composite material by controlling the temperature increase rate, thereby controlling the size of the thermal-shielding composite material manufactured.

For example, in the case of manufacturing a composite material using a mixed powder including a metal powder of aluminum or aluminum alloy and a polymer powder, the spark plasma sintering process is performed at a temperature in the range of 200° C. to 400° C. at a pressure in the range of 5 to 100 MPa for a duration of 1 to 10 minutes, thereby preparing a composite material for thermal shields.

In addition, in this step, after sintering the composite material for thermal shields as described above, the step of cooling the composite material may be further performed. In this case, it is possible to obtain a thermal-shielding composite material having excellent mechanical properties. In this step, it is possible to suppress the formation of voids formed on the surface and inside of the composite material by cooling the composite material under the condition of a fixed pressure.

According to the present disclosure, in the method of manufacturing a composite material for thermal shields, a polymer powder, a ceramic powder, and/or a metal powder having relatively low thermal conductivity is compounded with a metal material including aluminum through a sintering process using a powder metallurgy method such as pressureless sintering or spark plasma sintering. Thus, a heterogeneous composite material with a low-level thermal conductivity of 10 W/mk or less can be obtained. The composite material can be used as a material for various thermal shields.

Hereinafter, the embodiments of the present disclosure will be described in more detail by way of examples.

Examples disclosed in the present disclosure can be modified into various other forms, and the scope of the present disclosure is not construed as being limited to the examples described below. Examples are provided to more fully describe the present disclosure to the ordinarily skilled in the art.

EXAMPLE

In this example, a composite material for thermal shields was prepared by compounding a mixed powder in which aluminum or aluminum alloy powder and polymer powder are mixed through pressureless sintering or spark plasma sintering.

The aluminum alloy powder used in this example was a powder made of Al5052 or an Al—Mg alloy (AlSium) powder containing 50% by volume of aluminum and 50% by volume of magnesium, and the polymer powder was made of a polyarylate (PAR) resin.

For reference, polyarylate resin refers to an aromatic linear polyester resin, and it is a plastic engineering resin with various physical properties. The resin has high thermal resistance and excellent mechanical strength and is transparent. Therefore, this resin can be used for switches, sockets, microwave oven parts, relay cases, boards, etc. In addition, in the field of machinery, polyarylate resin is widely used as raw materials for internal/external parts of watches, optical mechanical parts, parts of thermal appliances such as gas circuit breakers, lenses in housings or automobile fields, electronic housings, instrument panels, and the like. It is also used for packaging materials. Polyarylate resin is usually prepared by polycondensation of an aromatic diol and an aromatic dicarboxylic acid.

First, a metal powder (aluminum or aluminum alloy powder) and a PAR powder were charged into a stainless steel vial of a ball milling apparatus, according to a predetermined volume ratio of any of the compositions listed in FIGS. 2 to 4, 20 mL of heptane was added thereto, and stainless steel balls with a diameter of 10 mm were added thereto. The weight ratio of the balls and the total amount of the powders was 5:1. After that, low-energy ball milling was performed at 160 rpm for 24 hours to produce a metal/polymer mixed powder. Then, the metal/polymer powder underwent to pressureless sintering or spark plasma sintering to produce a composite material for thermal shields.

Figure 2:
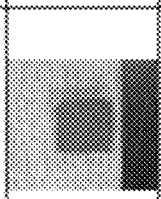
FIG. 2 is a photograph and illustrates electrical conductivity measurement results of a sample of an Al—Mg alloy (AlSium)/polyarylate (PAR) composite material prepared through pressureless sintering according to one embodiment of the present application.
Figure 2:
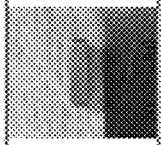

FIG. 2 shows photographs of samples of composite materials for thermal shields and electrical conductivity measurement results of the samples. Each of the samples was manufactured through the steps: performing press molding with a mixed powder including metal (AlSium) and polymer (PAR) at a pressure of 250 MPa to produce a molded article; and performing pressureless sintering on the molded article under conditions in which the temperature increase rate was 5° C./min, the sintering temperature was 350° C., and the sintering time was 1 hour. The sample with a PAR content of 15% by volume or more did not exhibit electrical conductivity, but the sample with a PAR content of 10% by volume (AlSium-and-10% by volume of PAR) exhibited electrical conductivity measured at the side surface of the sample. The sample also exhibited electric resistance when the electrical conductivity was measured.

Figure 4:
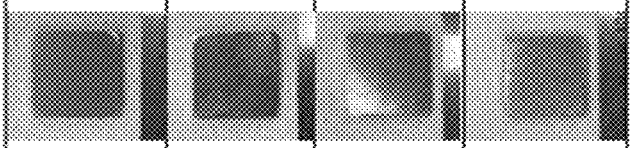
FIG. 4 is a photograph and illustrates electrical conductivity measurement results of a sample of a metal (AlSium, Al, Mg, Al5052)/polyarylate (PAR) composite material prepared through spark plasma sintering according to one embodiment of the present application.

FIGS. 3 and 4 show photographs and electrical conductivity measurement results of samples of composite materials for thermal shields. Each of the samples was manufactured through the steps: charging a mixed powder containing metal (AlSium, Al, Mg, or Al5052) and polymer (PAR) into a cemented carbide (WC—Co) mold coated with boron nitride (BN) and performing spark plasma sintering on the mixed powder under conditions in which the temperature increase rate was 50° C./min, the sintering temperature was 300° C., the sintering time was 3 minutes, and the sintering pressure was 40 MPa. Referring to the results, except for the case where the polymer content is excessively small (AlSium-10% by volume of PAR) or the case where an aluminum alloy with a relatively low magnesium content is included as a metal matrix (Al5052-30% by volume of PAR), it was confirmed that the degree of densification and electrical insulation of the sintered compact were excellent.

While exemplary embodiments of the present disclosure have been described with reference to the accompanying drawings, those skilled in the art will appreciate that the present disclosure can be implemented in other different forms without departing from the technical spirit or essential characteristics of the exemplary embodiments. Therefore, it can be understood that the exemplary embodiments described above are only for illustrative purposes and are not restrictive in all aspects.

According to the present disclosure, in the method of manufacturing a composite material for thermal shields, a polymer powder, a ceramic powder, and/or a metal powder having relatively low thermal conductivity is compounded with a metal material including aluminum. Thus, a heterogeneous composite material with a low-level thermal conductivity of 10 W/mk or less can be obtained. The composite material can be used as a material for various thermal shields.

What is claimed is:

1. A method of manufacturing a composite material for thermal shields, the method comprising:

preparing a mixed powder comprising (i) 30% to 85% by volume of a metal powder containing 50% by volume of aluminum and 50% by volume of magnesium and (ii) 15% to 70% by volume of a polyarylate (PAR) powder; and sintering the mixed powder through spark plasma sintering performed at a temperature in a range of 200° C. to 400° C. at a pressure in a range of 5 MPa to 100 MPa for a duration of 1 minute to 10 minutes to produce a composite material.

2. A composite material for thermal shields, manufactured by the method of claim 1.

3. The composite material of claim 2, wherein the composite material is a functionally graded material having a sheet shape and structured such that a volume fraction of the polyarylate (PAR) powder continuously changes from a first side to a second side of the sheet.

* * * * *